US010851619B2

(12) United States Patent
Stone et al.

(10) Patent No.: US 10,851,619 B2
(45) Date of Patent: Dec. 1, 2020

(54) TOP TOOTH BALL SEAT

(71) Applicants: Matthew C. Stone, Humble, TX (US); Colin Andrew, Cypress, TX (US); Omar Balcazar, Houston, TX (US); Partha Ganguly, Sugar Land, TX (US); Michael Johnson, Katy, TX (US); Alexander Kendall, Houston, TX (US); Daniel Sequera, Houston, TX (US)

(72) Inventors: Matthew C. Stone, Humble, TX (US); Colin Andrew, Cypress, TX (US); Omar Balcazar, Houston, TX (US); Partha Ganguly, Sugar Land, TX (US); Michael Johnson, Katy, TX (US); Alexander Kendall, Houston, TX (US); Daniel Sequera, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/998,426

(22) Filed: Aug. 15, 2018

(65) Prior Publication Data

US 2020/0056449 A1 Feb. 20, 2020

(51) Int. Cl.

| | |
|---|---|
| ***E21B 34/14*** | (2006.01) |
| ***E21B 34/06*** | (2006.01) |
| ***E21B 43/26*** | (2006.01) |

(52) U.S. Cl.

CPC ..... *E21B 34/14* (2013.01); *E21B 34/063* (2013.01); *E21B 43/26* (2013.01); *E21B 2200/04* (2020.05); *E21B 2200/06* (2020.05)

(58) Field of Classification Search

CPC ..... E21B 34/14; E21B 43/26; E21B 34/063; E21B 2034/002; E21B 2034/007

See application file for complete search history.

(56) References Cited

U.S. PATENT DOCUMENTS

| | | | | |
|---|---|---|---|---|
| 2010/0051291 | A1 | 3/2010 | Marcu | |
| 2012/0043077 | A1 | 2/2012 | Edwards | |
| 2012/0312557 | A1* | 12/2012 | King ..... | E21B 34/103 166/386 |
| 2014/0116721 | A1 | 5/2014 | Hofman et al. | |

(Continued)

FOREIGN PATENT DOCUMENTS

| | | | |
|---|---|---|---|
| CN | 203321473 | U | 12/2013 |

OTHER PUBLICATIONS

Notification of Transmittal of the International Search Report and the Written Opinion of the International Searching Authority, or the Declaration; PCT/US2019/046484; dated Dec. 5, 2019; ISR pp. 1-4; WO pp. 1-5; total 9 pages.

*Primary Examiner* — James G Sayre
(74) *Attorney, Agent, or Firm* — Cantor Colburn LLP

(57) ABSTRACT

A production system and a frac sleeve assembly of a frac assembly of the production system. The frac sleeve assembly includes a funnel section that reduces in diameter in a direction of an outlet of the frac assembly, a throat section having a selected diameter, and a ball seat at an intersection of the funnel section and the throat section for receiving a ball. When seated in the ball seat, an entire portion of a ball extending into the funnel section is exposed to disintegrating fluid in the funnel section.

10 Claims, 3 Drawing Sheets

(56) References Cited

U.S. PATENT DOCUMENTS

| | | | | |
|---|---|---|---|---|
| 2015/0369003 | A1* | 12/2015 | Hajjari | E21B 29/002 166/298 |
| 2017/0002628 | A1 | 1/2017 | Van Petegem et al. | |
| 2017/0204700 | A1* | 7/2017 | Hughes | E21B 43/14 |

* cited by examiner

TOP TOOTH BALL SEAT

BACKGROUND

In the resource recovery industry, formation fracturing ("fracking") is used to increase a hydrocarbon output from a reservoir by introducing fracking fluid from a production string into the reservoir. The production string includes a port and a frac sleeve that opens and closes the port to control flow of frac fluid into the reservoir. A ball is dropped on a ball seat of the frac sleeve to block a fluid passage and fluid pressure is applied to the ball to move the frac sleeve, thereby opening the port. When desired, a disintegrating fluid is pumped downhole to dissolve the ball, thereby closing the port. However, due to the geometry of ball seat designs, degradation occurs unevenly and the ball is likely to become cemented into the ball seat, rather than dissolved out of the ball seat. Accordingly, there is a need for a ball seat configuration that allows for suitable degradation.

SUMMARY

A frac sleeve assembly of a frac assembly includes a funnel section that reduces in diameter in a direction of an outlet of the frac assembly; a throat section having a selected diameter; and a ball seat at an intersection of the funnel section and the throat section for receiving a ball, wherein an entire portion of a ball extending into the funnel section when seated in the ball seat is exposed to disintegrating fluid in the funnel section.

A production system includes a production string; and a frac assembly disposed on the production string, the frac assembly including: a funnel section that reduces in diameter in a direction of an outlet of the frac assembly; a throat section having a selected diameter; and a ball seat at an intersection of the funnel section and the throat section for receiving a ball, wherein an entire portion of a ball extending into the funnel section when seated in the ball seat is exposed to disintegrating fluid in the funnel section.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
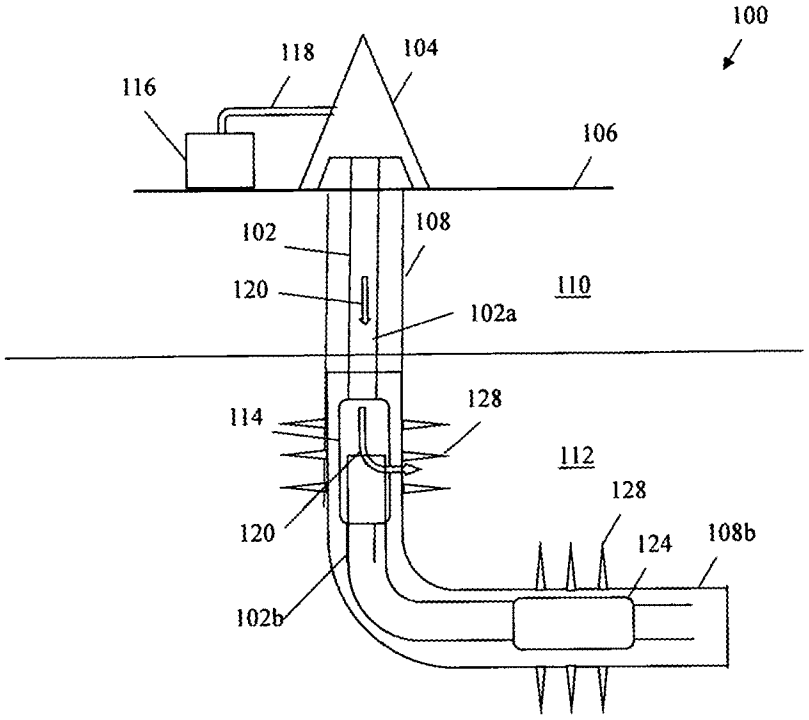
FIG. 1 shows an illustrative production system.

Referring to FIG. 1, an illustrative production system 100 is shown. The production system includes a production string 102 extending from a rig 104 located at a surface location 106. The production string 102 extends through a wellbore 108 penetrating a formation 110 and a reservoir 112 in the formation 110. A fracture ("frac") assembly 114 is disposed on the production string 102 at a location in the reservoir 112 for the purposes of fracking the reservoir 112. The frac assembly 114 is disposed between a first section 102*a* of the production string 102 and a second section 102*b* of the production string 102. A second frac assembly 124 can be disposed at a lower end of the second section 102*b*. Additional frac assemblies (not shown) can be used at lower sections of the production string 102. As shown in FIG. 1, the wellbore 108 can deviate to have a horizontal section 108*b* and the production string 102 can deviate along with the wellbore 108 to extend through the horizontal section 108*b*. One or more of the frac assemblies (such as second frac assembly 124) can be disposed within the horizontal section.

With the frac assembly 114 disposed in the reservoir 112, a frac fluid 120 is pumped from a frac fluid storage device 116 through delivery pipe 118 and down through the production string 102 to exit the frac assembly 114 into the reservoir 112. In various embodiments, the reservoir 112 can include various perforations 128 formed therein by which the frac fluid 120 passes into the reservoir 112. Proppant entrained in the frac fluid 120 is carried into the perforations 128 in order to prop the perforations 128 open, thereby allowing for increased hydrocarbon recovery from the reservoir 112.

Figure 2:
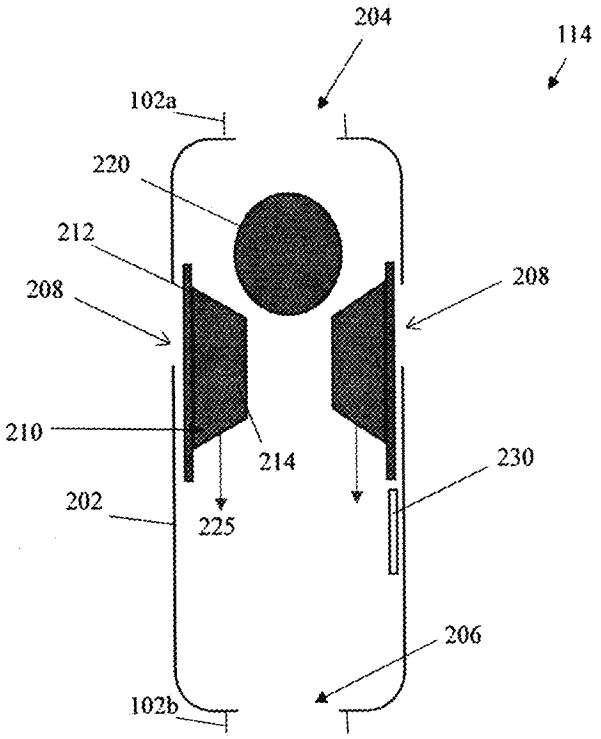
FIG. 2 shows a detailed diagram of an illustrative frac assembly of the production system.

FIG. 2 shows a detailed diagram of an illustrative frac assembly 114 of the production system 100 in various embodiments. The frac assembly 114 includes a housing 202 coupled to the production string 102. The housing 202 includes an inlet 204 at an intersection of the housing 202 and the first section 102*a* of the production string 102. The housing 202 also includes an outlet 206 at an intersection of the housing 202 and the second section 102*b* of the production string 102. The housing 202 further includes one or more ports 208 on the side of the housing 202 for delivery of frac fluid from the frac assembly 114 into the reservoir 112. The ports 208 can be opened or closed based on a position of a frac sleeve assembly 210.

The frac sleeve assembly 210 includes a sleeve 212 and a ball seat assembly 214 that define a fluid passage through the frac sleeve assembly 210. Fluid can pass from the inlet 204 to the outlet 206 by passing through the frac sleeve assembly 210. The frac sleeve assembly 210 can be moved by dropping a ball into the production string 102 at the surface and allowing the ball to settle onto the ball seat assembly 214, thereby blocking the flow of fluid from the inlet 204 to the outlet 206. A fluid pressure provided by fluid entering the frac sleeve assembly 210 from the inlet 204 is then applied to the ball 220, forcing the frac sleeve assembly 210 to move towards the outlet 206 as indicated by arrows 225. In various embodiments, the frac sleeve assembly 210 is secured to the housing 202 via shear screws (not shown) and the fluid pressure is applied above a breaking threshold for the shear screws. Once the shear screws are broken, the frac sleeve assembly 210 moves toward the outlet 206 under fluid pressure and uncovers ports 208, allowing the frac fluid to flow out of the housing 202 via the ports 208 and into the reservoir 112. The ports 208 are closed by moving the face sleeve assembly 210 toward the inlet 204. The frac sleeve assembly 210 is moved toward the inlet 204 by disintegrating the ball 220, thereby relieving the downward pressure of the fluid on the frac sleeve assembly 210. A biasing device such as a spring 230 can then return the frac sleeve assembly 210 to its original position in which it covers, and thereby closes, ports 208.

The ball 220 is designed to disintegrate when exposed to a disintegrating fluid such as the frac fluid at a selected temperature. In general, the disintegrating fluid that forces the ball 220 into the ball seat assembly 214 is provided into the production string 102 at a temperature (e.g., about 100° Celsius) below a reaction temperature for the ball 220 and the disintegrating fluid. Over time, the temperature of the disintegrating fluid rises to thermal equilibrium with the downhole temperature. At the downhole temperature, the disintegrating fluid or fraction fluid 120 chemically interacts with the ball 220 in order to disintegrate the ball 220. The disintegration process is designed to reduce the size of the ball 220, allowing the ball 220 to pass through the ball seat assembly 214, thereby relieving the pressure from the frac sleeve assembly 210 and allowing the frac sleeve assembly 210 to return to its original position.

Figure 3:
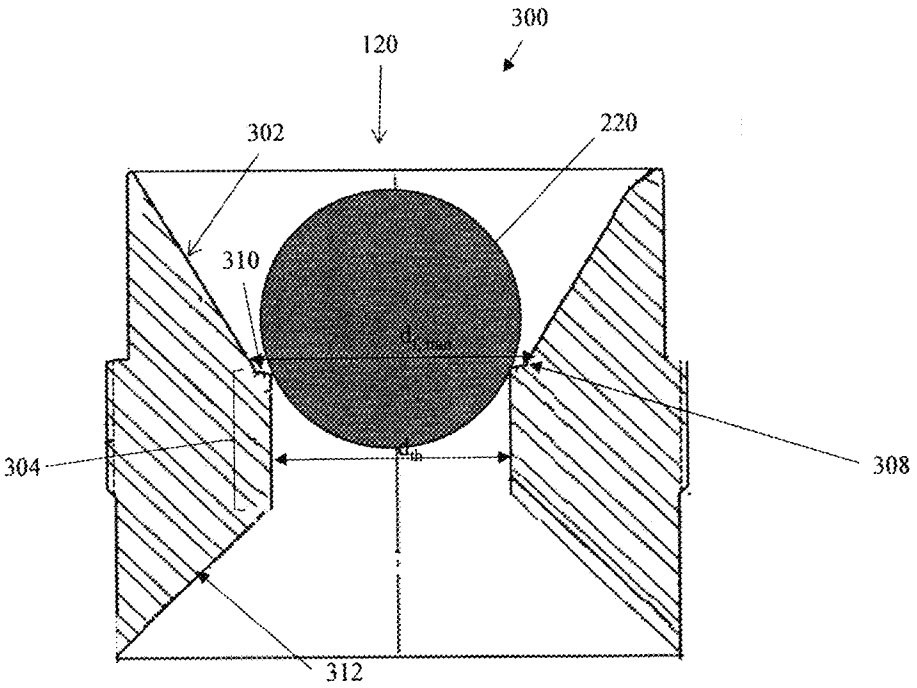
FIG. 3 shows a ball seat assembly of the present invention.

FIG. 3 shows a ball seat assembly 300 of the present invention. The ball seat assembly 300 defines a longitudinal axis and is oriented so that the longitudinal axis is vertically oriented. The ball seat assembly 300 includes a funnel section 302 which includes a conical section that continuously decreases in inner diameter in the direction of the outlet 206, FIG. 2. The ball seat assembly 300 also includes a throat section 304 having a single inner diameter ($d_{th}$), which is a constant diameter. The funnel section 302 meets the throat section 304 at an intersection 308. In one embodiment, the smallest inner diameter ($d_{f,min}$) of the funnel section matches the inner diameter of the throat section 304. In another embodiment, the intersection 308 can include a ball seat that can include ridge 310 or be without ridge. In various embodiments including a ridge 310, the ridge 310 extends from the inner diameter ($d_{f,min}$) of the funnel section at the intersection 308 radially inward to the inner diameter $d_{th}$ of the throat section 304. The ball 220 sits on the ridge 310 such that an entire portion of the ball 220 in the region above the ridge 310 (i.e., the portion of the ball 220 extending into the funnel section) is exposed to the disintegrating fluid (i.e., the frac fluid 120). The ball 220 therefore dissolves without cementing itself into the ball seat assembly. In other words, the size of ball 220 reduces during the disintegration process, allowing the ball 220 to pass through the throat section 304. The ball seat assembly further includes a tail section 312 downstream of the throat section 304. The tail section 312 includes a funnel having an inner dimeter that increases in the direction of the outlet 206, FIG. 2.

Due to the tendency of the ball 220 to be dislodged from the ball seat or ridge 310 when the frac assembly is in a horizontal or substantially horizontal position, the ball seat assembly 300 of FIG. 3 is more suitable for use in a frac assembly having a vertical orientation, such as in a vertical wellbore or a vertical section of a wellbore.

Set forth below are some embodiments of the foregoing disclosure:

Embodiment 1

A frac sleeve assembly of a frac assembly, comprising: a funnel section that reduces in diameter in a direction of an outlet of the frac assembly; a throat section having a selected diameter; and a ball seat at an intersection of the funnel section and the throat section for receiving a ball, wherein an entire portion of a ball extending into the funnel section when seated in the ball seat is exposed to disintegrating fluid in the funnel section.

Embodiment 2

The frac sleeve assembly as in any prior embodiment, wherein the ball seat is located at an end of the throat section adjacent the funnel section.

Embodiment 3

The frac sleeve assembly as in any prior embodiment, wherein the ball seat forms a ridge at the intersection of the funnel section and the throat section.

Embodiment 4

The frac sleeve assembly as in any prior embodiment, wherein the ridge extends radially from a smallest diameter of the funnel section to the selected diameter of the throat section.

Embodiment 5

The frac sleeve assembly as in any prior embodiment, wherein the smallest diameter of the funnel section is greater than the selected diameter of the throat section.

Embodiment 6

The frac sleeve assembly as in any prior embodiment, wherein the throat section has a constant diameter.

Embodiment 7

The frac sleeve assembly as in any prior embodiment, wherein a longitudinal axis of the throat section is oriented vertically.

Embodiment 8

A production system, comprising: a production string; and a frac assembly disposed on the production string, the frac assembly comprising: a funnel section that reduces in diameter in a direction of an outlet of the frac assembly; a throat section having a selected diameter; and a ball seat at an intersection of the funnel section and the throat section for receiving a ball, wherein an entire portion of a ball extending into the funnel section when seated in the ball seat is exposed to disintegrating fluid in the funnel section.

Embodiment 9

The production system as in any prior embodiment, wherein the ball seat is located at an end of the throat section adjacent the funnel section.

Embodiment 10

The production system as in any prior embodiment, wherein the ball seat forms a ridge at the intersection of the funnel section and the throat section.

Embodiment 11

The production system as in any prior embodiment, wherein the ridge extends radially from a smallest diameter of the funnel section to the selected diameter of the throat section.

Embodiment 12

The production system as in any prior embodiment, wherein the smallest diameter of the funnel section is greater than the selected diameter of the throat section.

Embodiment 13

The production system as in any prior embodiment, wherein the throat section has a constant diameter.

Embodiment 14

The production system as in any prior embodiment, wherein a longitudinal axis of the throat section is oriented vertically.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frac sleeve assembly of a frac assembly, comprising:
- a funnel section that reduces in diameter in a direction of an outlet of the frac assembly;
- a throat section having a selected diameter, wherein the throat section and the funnel section meet at an intersection at a location along a longitudinal axis of the frac sleeve assembly; and
- a ball seat at the intersection for receiving a ball, the ball seat is a horizontal ridge with respect to a vertical direction of the longitudinal axis at the intersection, the ridge extending along a radial line from a smallest diameter of the funnel section to the selected diameter of the throat section, wherein a ball dropped onto the ball seat sits entirely on the ridge with an entire portion of the ball extending from the ridge into the funnel section when the ball is seated on the ridge being exposed to disintegrating fluid in the funnel section.

2. The frac sleeve assembly of claim 1, wherein the ball seat is located at an end of the throat section adjacent the funnel section.

3. The frac sleeve assembly of claim 1, wherein the smallest diameter of the funnel section is greater than the selected diameter of the throat section.

4. The frac sleeve assembly of claim 1, wherein the throat section has a constant diameter.

5. The frac sleeve assembly of claim 1, wherein the longitudinal axis of the throat section is oriented vertically.

6. A production system, comprising:
- a production string; and
- a frac assembly disposed on the production string, the frac assembly comprising:
  - a funnel section that reduces in diameter in a direction of an outlet of the frac assembly;
  - a throat section having a selected diameter, wherein the throat section and the funnel section meet at an intersection at a location along a longitudinal axis of the frac sleeve assembly; and
  - a ball seat at the intersection for receiving a ball, the ball seat is a horizontal ridge with respect to a vertical direction of the longitudinal axis at the, the ridge extending along a radial line from a smallest diameter of the funnel section to the selected diameter of the throat section, wherein a ball dropped onto the ball seat sits entirely on the ridge with an entire portion of the ball extending from the ridge into the funnel section when the ball is seated on the ridge being exposed to disintegrating fluid in the funnel section.

7. The production system of claim 6, wherein the ball seat is located at an end of the throat section adjacent the funnel section.

8. The production system of claim 6, wherein the smallest diameter of the funnel section is greater than the selected diameter of the throat section.

9. The production system of claim 6, wherein the throat section has a constant diameter.

10. The production system of claim 6, wherein the longitudinal axis of the throat section is oriented vertically.

* * * * *